United States Patent [19]

Ryon et al.

[11] Patent Number: 4,852,507

[45] Date of Patent: Aug. 1, 1989

[54] SAIL-WING AND CONTROLS FOR A SAIL CRAFT

[75] Inventors: Randall C. Ryon, 36 Alina St., Fairport, N.Y. 14450; Robert A. Austin, Penfield, N.Y.

[73] Assignee: Randall C. Ryon, Fairport, N.Y.

[21] Appl. No.: 141,486

[22] Filed: Jan. 7, 1988

[51] Int. Cl.[4] ..... B63H 9/04

[52] U.S. Cl. ..... 114/39.1; 114/102; 114/144 R; 114/362

[58] Field of Search ..... 114/39.1, 102, 103, 114/109, 111, 362, 144 R, 162, 344, 283, 123

[56] References Cited

U.S. PATENT DOCUMENTS

| | | | |
|---|---|---|---|
| 3,802,366 | 4/1974 | Mankawich | 114/61 |
| 3,921,561 | 11/1975 | Arce | 114/165 |
| 3,985,090 | 10/1976 | Rineman | 114/163 |
| 4,027,614 | 6/1977 | Jones | 114/61 |
| 4,068,607 | 1/1978 | Harmon | 114/102 |
| 4,235,450 | 11/1980 | Conover | 114/344 |
| 4,561,371 | 12/1985 | Kelley et al. | 114/61 |
| 4,569,301 | 2/1986 | Pyburn | 114/61 |

FOREIGN PATENT DOCUMENTS

| | | | |
|---|---|---|---|
| 1184914 | 3/1970 | United Kingdom | 114/102 |

*Primary Examiner*—Sherman D. Basinger
*Assistant Examiner*—Edwin L. Swinehart
*Attorney, Agent, or Firm*—Robert J. Bird

[57] ABSTRACT

An amphibious sail craft with a sail-wing system is disclosed, including a rotatably mounted mast, a rotatable boom pivotally mounted to the mast, and a sail-wing mounted to the boom and rotatable with the boom about horizontal and vertical axes for varying the attitude of the sail-wing among sail positions or wing positions or combinations thereof. Mechanism to turn the mast and to rotate and tilt the boom to thereby control the attitude of the sail-wing includes: sheets to rotate the boom about its axis; a control wheel to selectively pull one or the other of the sheets, or to pull them both to control the rearward tilt of the boom; and a control column and reaction gear to turn the mast away from the movement of the control column.

18 Claims, 6 Drawing Sheets

SAIL-WING AND CONTROLS FOR A SAIL CRAFT

BACKGROUND OF THE INVENTION

1. Field of the invention

This invention relates to a sail craft with a combination sail and wing for both sailing and gliding, and to the mechanical controls for the same.

2. Background Information

Wind surfing, also known as boardsailing, is a relatively recent development in the art of sailing. As far as we know, this development began with the mono-hull sailboard on which a single pilot stands, as on a surfboard, and manipulates the sail.

Through recent extensions of technique and equipment, mono-hull wind surfers have taken on an ability to soar. This added soaring capability is achieved by using the sail as both a sail and a wing, and moving the sail from its sailing position which is generally perpendicular to the deck plane of the craft, to a soaring position more or less parallel to the deck plane of the craft, at which it becomes a wing. In the most relevant prior art known to us, this combination sail-wing is operated by direct manipulation of the structural members such as the boom and other framing to which the sail is mounted. An example of this is a mono-hull sailboard marketed under the trademark Wind Weapons. This prior art device is shown and described in U. S. Pat. No. 4,682,557, entitled Sailing Wing, and issued July 28, 1987 to Magruder and Crowell. U.S. Pat. No. 4,682,557 represents our point of departure from the prior art.

It is an object of this invention to provide a sail craft with a combination sail and wing, and with mechanical controls to effect its movements between sailing and soaring positions.

Defining certain terms, "left" and "right" are used herein as from the rear of the craft, the viewpoint of the pilot. A "sheet" is a rope, cable, or chain that regulates the attitude of a sail in relation to the wind. The sail craft of this invention may sometimes hereinafter be referred to as a "beach cat". The combination sail and wing will be referred to hereinafter as a "sail-wing".

SUMMARY OF THE INVENTION

According to the present invention, there is provided an amphibious sail craft with a sail-wing system, including a mast rotatably mounted to the sail craft, a rotatable boom pivotally mounted to the mast, and a sail-wing mounted to the boom and rotatable with the boom about horizontal and vertical axes for varying the attitude of the sail-wing among various sail positions or wing positions or combinations thereof. Mechanism to control the rotation and tilt of the boom, and the rotation of the mast, to thereby control the attitude of the sail-wing includes: sheets connected to the boom to rotate the boom about its axis; a control wheel to selectively pull one or the other of the sheets, or to pull them both to control the rearward tilt of the boom; and a control column and reaction gear connected to the mast to rotate the mast in a direction of rotation opposite to the horizontal direction of rotation of the control column.

DESCRIPTION OF THE PREFERRED EMBODIMENT

Figure 1:
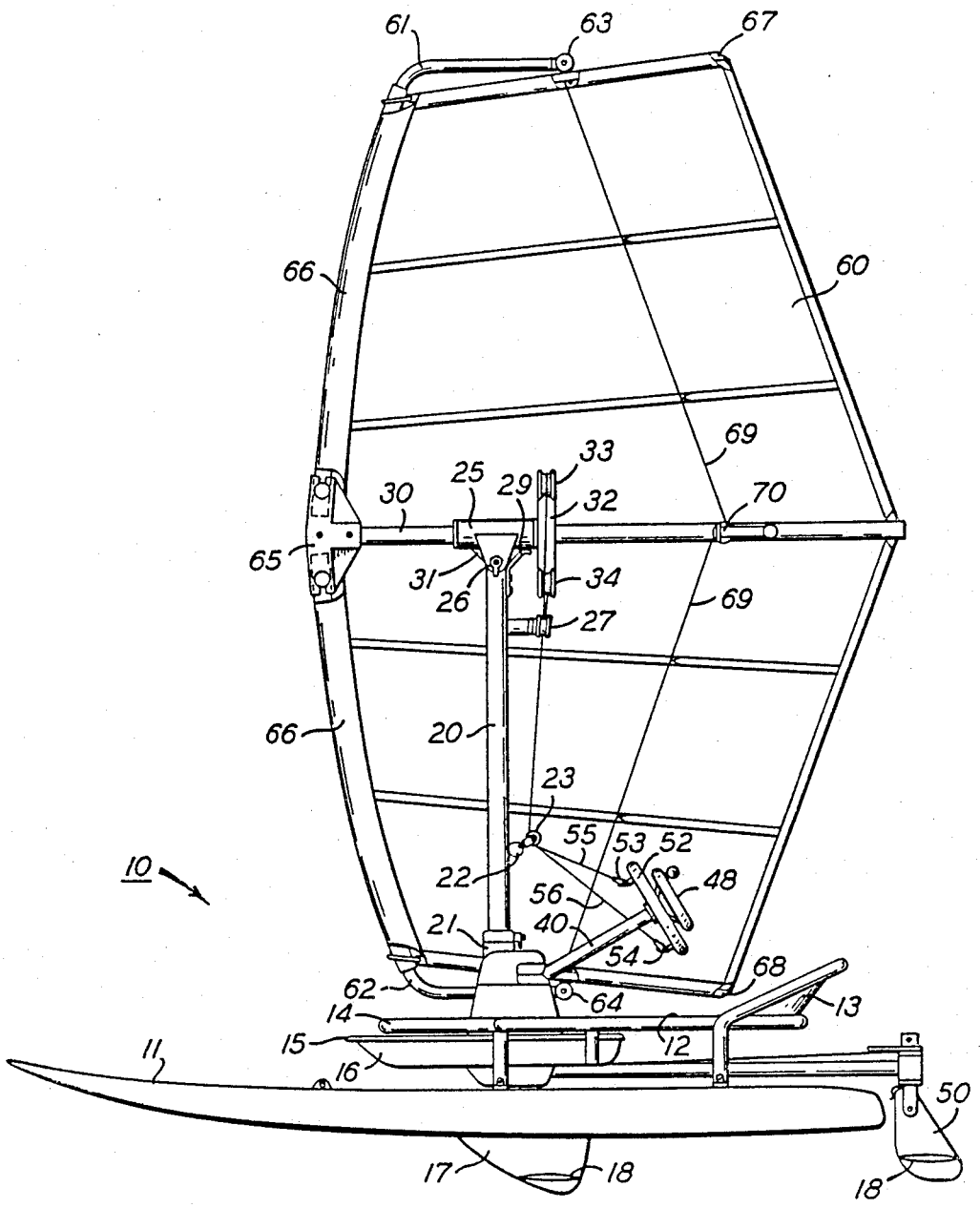
FIG. 1 is a side view of a sail craft according to this invention, with its sail-wing in a sail position.
Figure 2:
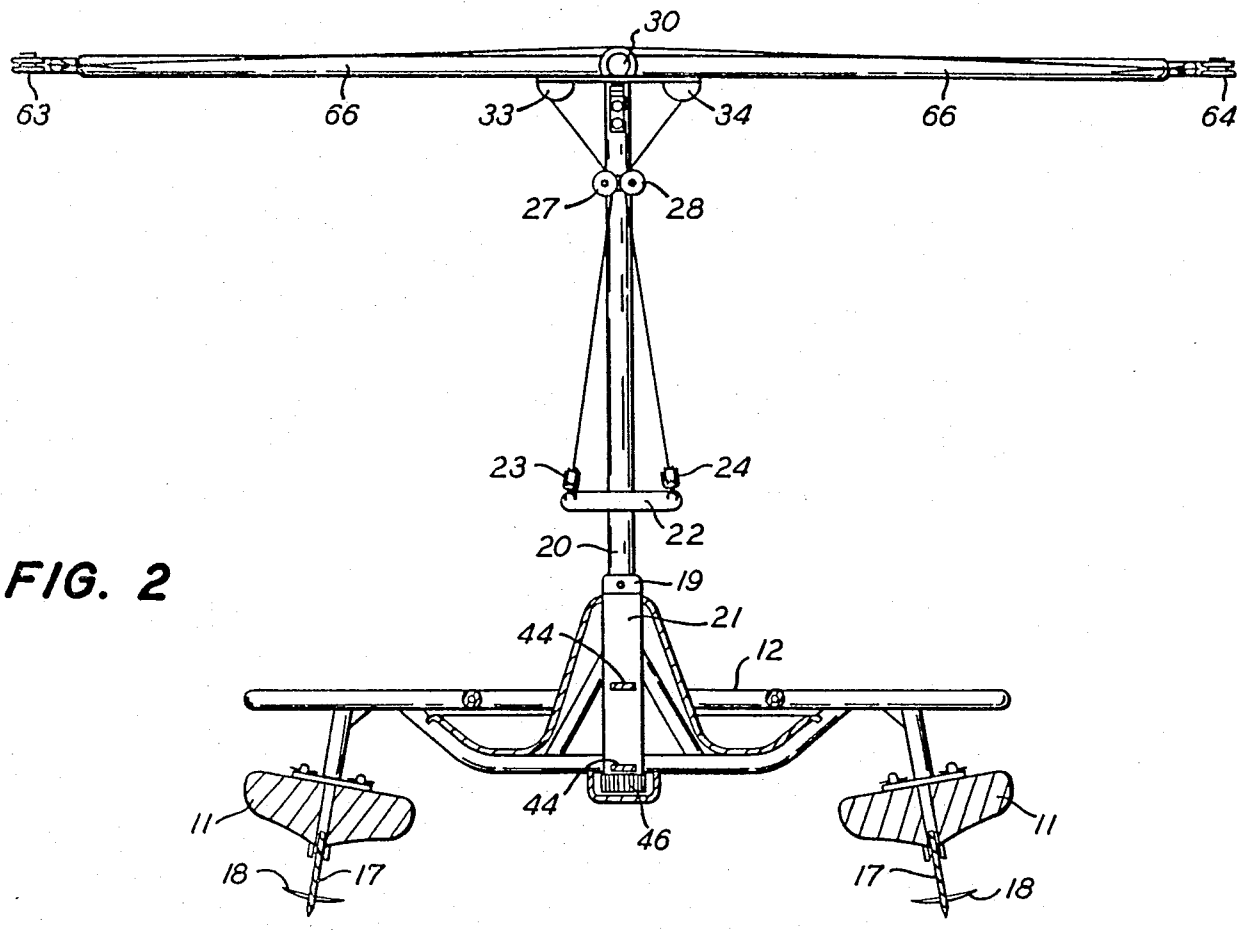
FIG. 2 is a partial sectional view, looking forward from immediately behind the mast, of the sail craft with its sail-wing in a wing position.
Figure 3:
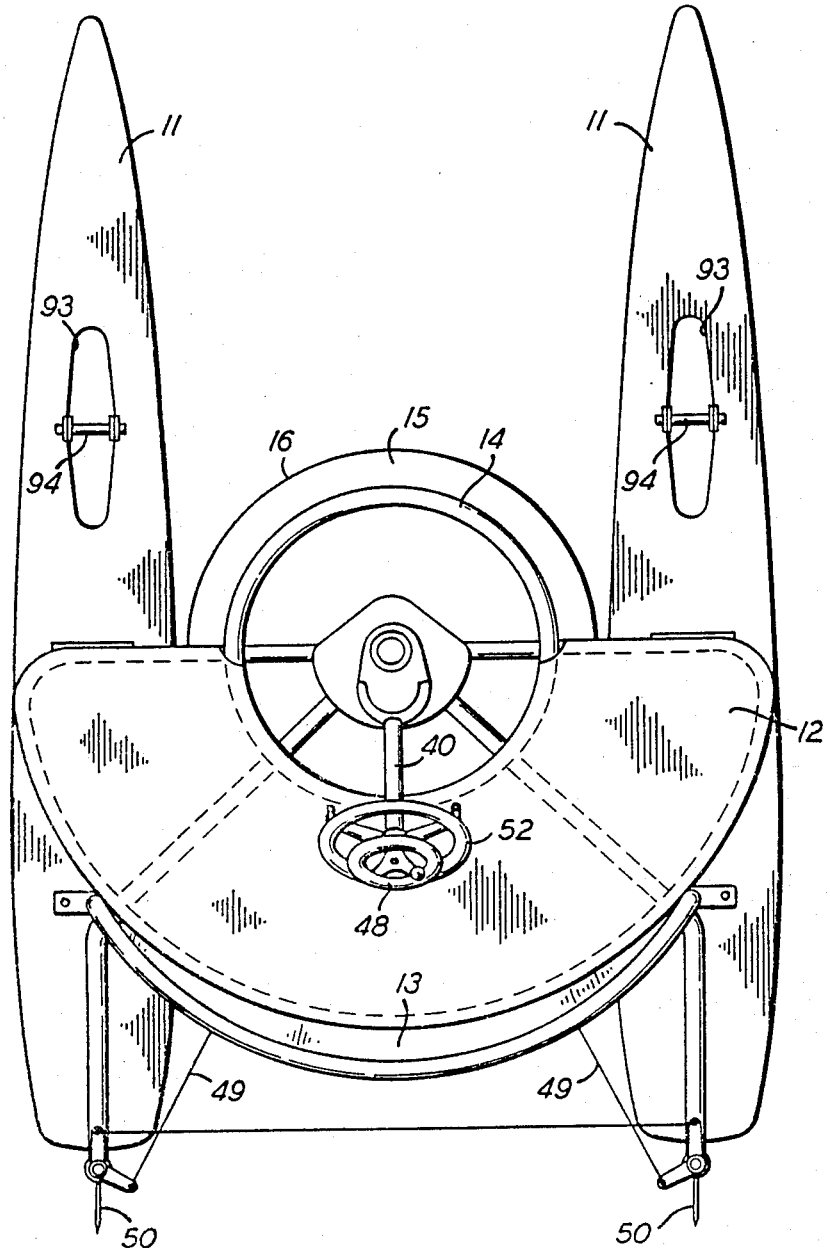
FIG. 3 is a top view of the sail craft without the sail-wing.

Referring now to FIGS. 1–3, a sail craft 10 includes twin planing hulls 11 connected by a bridging platform 12. Platform 12, on which the pilot sits, supports a back stop 13 across its back end and a curved foot rail 14 across its forward end. Below the foot rail, a concave floor plan 15 provides additional foot or heel support, and includes forward and side walls 16 providing some splash protection and a hold for loose articles. By means of the back stop 13 and foot rail 14, the pilot can gain a purchase and the necessary leverage to reposition himself and to operate the sail craft. Each hull 11 includes a centerboard 17. Centerboards 17 may further include horizontal fins or hydrofoils 18. The planing hulls 11 are somewhat inwardly inclined.

A mast support sleeve 21 (see also FIG. 4) is a hollow cylindrical sleeve fixedly mounted relative to the platform 12. Mast support 21 includes an upper collar 19 which is rotatable within the sleeve 21, but restrained from axial movement relative to it. A mast 20 is removably mounted within the support sleeve 21 and is locked by means of a releasable pin 39 to the collar 19 so as to be rotatable relative to the support sleeve 21. A mast cross arm 22 is fixed at an intermediate location on the mast 20. A left sheet pulley 23 is mounted at the left end, and a right sheet pulley 24 at the right end, of the cross arm 22. An opposed pair of centering pulleys 27 and 28 are mounted on the mast 20, upward from the cross arm 22. In a simpler form, a single centering eyebolt might be substituted for the pair of centering pulleys 27 and 28. A hollow cylindrical boom pivot sleeve 25 is pivotally mounted at or near the top of the mast 20 by a removable pivot pin 26. A spring, such as a leaf spring 29, is operatively connected between the mast 20 and the pivot sleeve 25 to urge the pivot sleeve 25 against a stop 31 to establish a normal or at-rest position for the pivot sleeve 25 perpendicular to the mast 20.

A boom 30 is mounted through the pivot sleeve 25, and extends forward and rearward of the pivot sleeve. The boom 30 is rotatable within the pivot sleeve 25, and is axially fixed to it. A boom cross arm 32 is fixed to the boom 30 at a point to the rear of the pivot sleeve 25. The boom cross arm 32 includes a left end connection point or pulley 33, and a right end connection point or pulley 34. Pulleys 33 and 34 project from the plane of the boom 30 and cross arm 32. Boom 30 and all that is mounted to it are removable from the mast 20 by removal of the pivot pin 26 which connects the pivot sleeve 25 to the mast 20.

As to the apparatus so far described, the mast 20 is rotatable within its support sleeve 21 relative to the platform 12. The boom 30 is both rotatable within the boom pivot sleeve 25, and to a limited extent pivotable up and down relative to the mast 20.

Referring now particularly to FIG. 1, a combination sail and wing, or sail-wing 60 is mounted on the boom 30. The sail-wing is supported by a pair of bowed sail frame members 61 and 62 connected to and extending in opposite directions from a tee 65 mounted on the forward end of the boom 30. Sail frame member 61 includes a pulley 63 at its outer end. Similarly, sail frame member 62 includes a pulley 64 at its outer end. The sail-wing includes forward sleeves 66, which slip over the frame members 61 and 62. Edge frame members 67 and 68 are inserted into sleeves to support the outer ends of the sail-wing, and are slidably connected to their respective frame members 61 and 62. A winch 70 is rotatably mounted on the boom 30. A rope or line 69 extends from connection with edge frame member 67, over the pulley 63, through the center of winch 70, and over the opposite pulley 64 to connect with the opposite edge frame member 68. The sail wing is wound taut on the frame members 61 and 62 by winch 70 acting through line 69 and pulleys 63 and 64 respectively. The underside of the handle of crank 70 includes a hook or projecting pin to engage the line 69 to prevent the crank from unwinding or unloading under tension. Loosening of the line 69 permits removal of the main frame members 61 and 62 from the connecting tee 65 to collapse the sail. The pulleys are preferably open-faced for ease and speed of connection and disconnection. The sail-wing is of nylon or other sail fabric, and may include additional ribbing, battens, and a clear panel for viewing.

Figure 4:
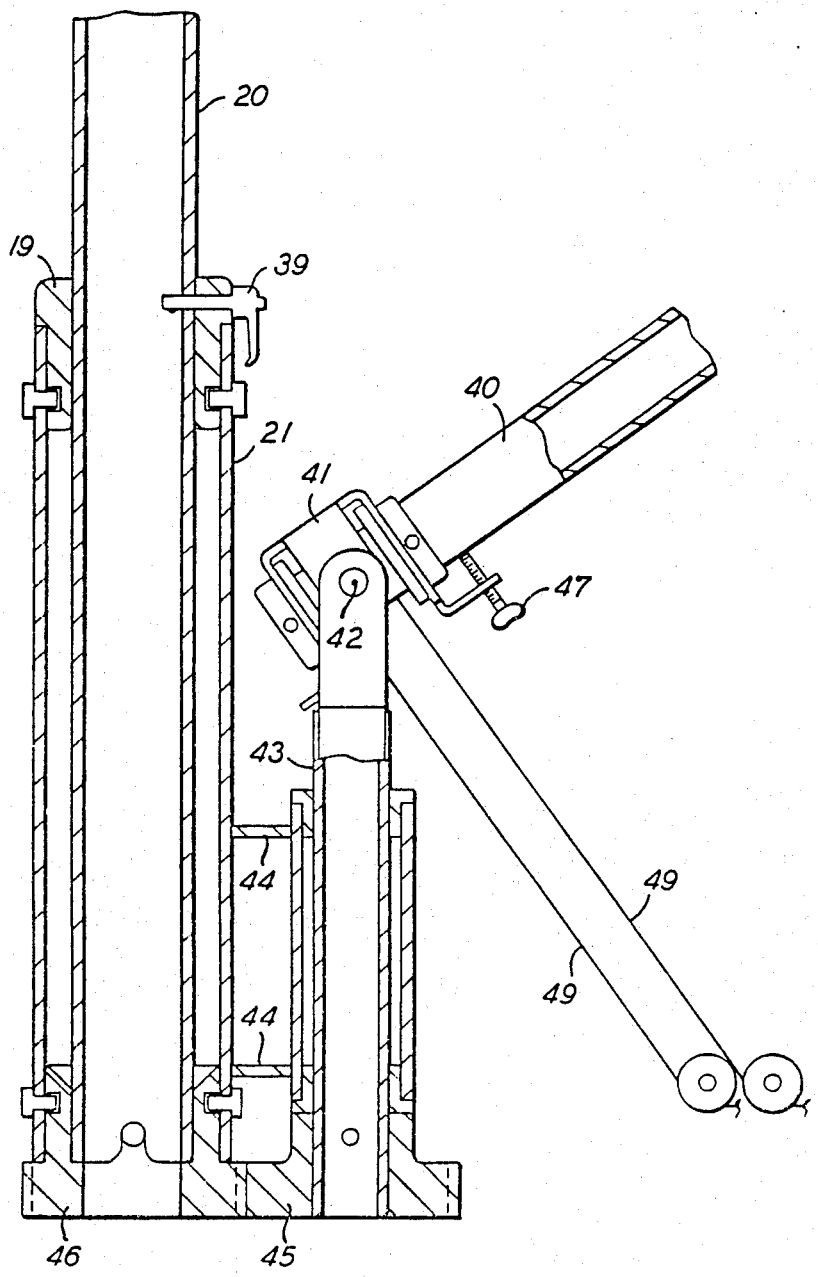
FIG. 4 is an enlarged side sectional view of the lower end of the mast, with the sail-wing controls of this invention.
Figure 5:
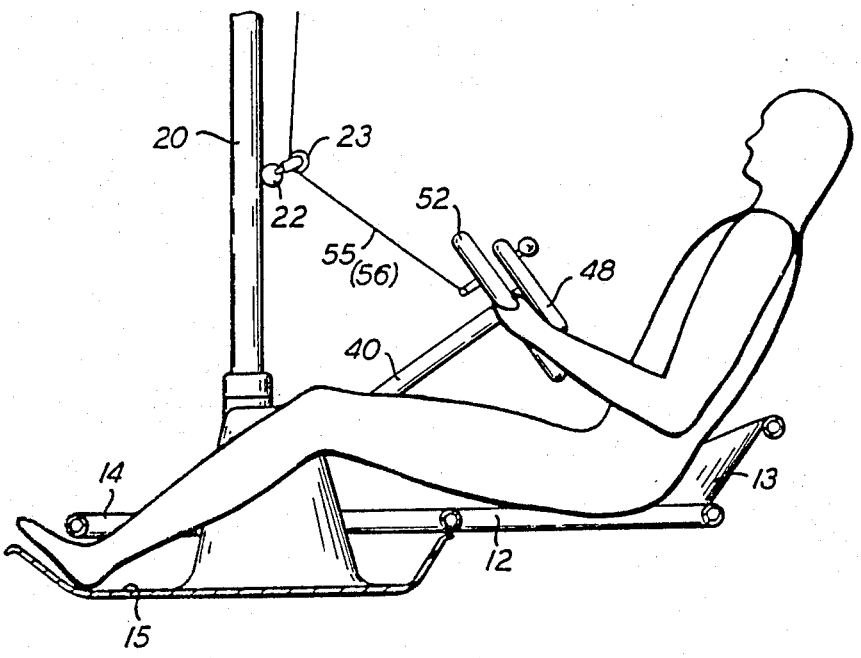
FIG. 5 is a side elevation of the pilot area of the craft, showing a pilot in an operative position.

Referring now particularly to FIGS. 1 and 4, a control column 40 is rotatably mounted on a yoke 41 which is vertically pivotable on a horizontal pivot pin 42 on the end of a rotatable vertical spindle 43. Spindle 43 is rotatably mounted on a pair of mounting brackets 44 which are fixed to the mast support sleeve 21. A control gear 45 is fixed to the spindle 43 for rotation with it, and a mating reaction gear 46 is fixed to the mast 20 for rotation with it. In this arrangement, control column 40 is thus rotatable within yoke 41, vertically pivotable on pivot pin 42, and horizontally rotatable with spindle 43 and control gear 45. A locking mechanism 47 may be provided to secure column 40 from rotation relative to yoke 41, thus locking the steering mechanism in place while permitting column 40 to swing laterally and vertically to perform its sail-wing control functions.

A steering wheel 48 is fixed to the upper end of the control column 40. Control column 40 is, in turn, operatively connected to a rudder or rudders 50 by a steering cable 49 in a well known manner.

A sail-wing control wheel 52 is rotatably mounted on the control column 40 adjacent the steering wheel 48 so that both wheels 48 and 52 are convenient to the pilot. Control wheel 52 includes diametrically opposed connection points, such as eyebolts 53 and 54. A left sheet 55 is releasably connected to the left eyebolt 53 on the control wheel 52, extends through the left sheet pulley 23 on the mast cross arm 22, through centering pulley 27, and is releasably connected at the left end connection point or pulley 33 of the boom cross arm 32. A right sheet 56 is similarly releasably connected to the right eyebolt 54 on the control wheel 52, extends through the right sheet pulley 24 on the mast cross arm 22, through centering pulley 28, and is releasably connected at the right end connection point or pulley 34 of the boom cross arm 32.

In operation, consider FIG. 1 as representing the typical sailing condition. The pilot is sitting somewhat on the high side of the boat and the sail-wing is more or less "vertical" for sailing in the normal manner. In FIG. 2, the pilot has shifted his seating position to the center of the bridging platform 12 and the sail-wing is in a "horizontal" attitude or wing position. The control of the sail-wing from a vertical to a horizontal attitude, or from horizontal to vertical, is accomplished by both rotation of the control wheel 52 and by side-to-side lateral movement of the control column 40. Turning the control wheel 52 pulls one or the other of the sheets to raise or lower the sail-wing. Lateral movement of the control column 40 correspondingly rotates the control gear 45, which rotates the reaction gear 46 and mast 20 in the opposite direction. The sheet pulleys 23 and 24 are at the ends of the mast cross arm 22 and therefore spaced from each other. The effect of this spacing is that when the pilot and the control column shift from, say the center to the left, the right sheet pulley 24 moves in the opposite direction and recedes from the right connecting point 54 of the control wheel so that the right sheet 56 pulls down on the sail-wing at connection point 34 on the boom cross arm 32. Conversely, the left sheet pulley 23 simultaneously moves toward the left connecting point of the control wheel providing the slack in left sheet 55 permitting its connection point 33 on the boom cross arm to rise. This control of the sheets 55 and 56 resulting from side-to-side movement is additional to the sheet control provided by turning the control wheel 52. The pilot maneuvers his body as a counterweight, using the curved foot rail 14 and floor plan 15, and seat 12 and back stop 13. The sail-wing, during its normal operational movements, pivots over and around the pilot. Thus, the sail-wing and the normal side-to-side movements of the pilot do not interfere. The sail-wing pivot point, i.e. pivot sleeve 25 and pivot pin 26, is slightly ahead of but close to the center of the sail-wing 60 for best control.

Assume an initial condition as in FIG. 1. The change from the FIG. 1 sailing condition to the soaring condition of FIG. 2 is made by rotating the control wheel 52 approximately 90 degrees counterclockwise to partially level the sail-wing by means of the sheets 55 and 56, and by shifting the control shaft position to further level the sail-wing through the mechanism of control gear 45, reaction gear 46, and mast 20, all further working against sheets 55 and 56 and adding to the effect of the control wheel 52. From the other side of the vessel, to place the vessel in the opposite tack from a soaring condition, the rotations and movements are in directions opposite those just described.

Simply to move the control column 40 from center to left, without rotation of the control wheel 52, has the effect of partially tilting the sail-wing to its sailing position. Return to the center position, again without rotation of the control wheel, places the sail-wing in its horizontal soaring position. In the same way, in the opposite direction, moving the control column 40 from center to right partially tilts the sail-wing to its opposite sailing position, and return to the center position again places the sail-wing in its horizontal soaring position. In actual use, it is expected that control will be achieved by combined lateral movement of the control column 40, and rotation of the control wheel 52 on its axis.

With the sail-wing in its horizontal position, the forward-rearward wing tilt, and the resulting wing lift, is controlled by the upward-downward pivot or tilt of the control column 40, and with it both sheets 55 and 56, effecting the tilt of the boom 30 on its pivot pin 26. When the sail-wing is positioned vertically, it operates in much the same way as a standard sail. The sheet control wheel 52 is used to rotate the boom and sail-wing 180° when coming about. The horizontal wing position is used to glide or soar when the craft leaves a wave at an upward angle with adequate speed. When the craft is stationary, the sail-wing in this wing position also becomes an umbrella or a sun shade.

Figure 6:
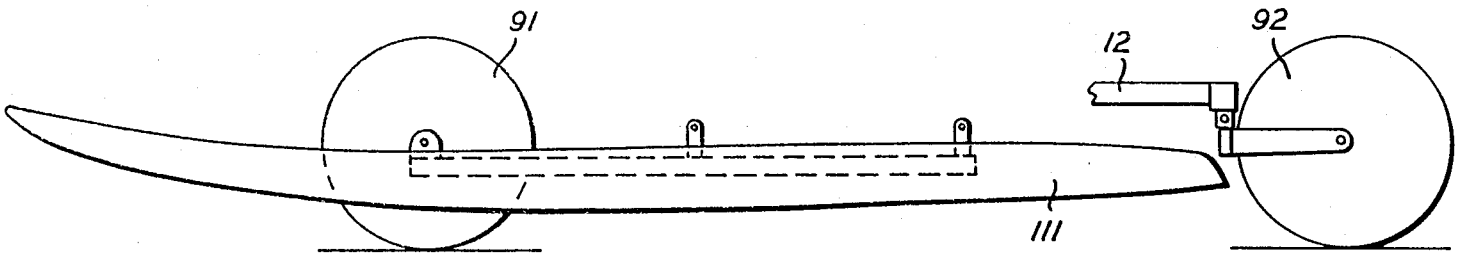
FIG. 6 is a partial side view of a hull according to a modified form of this invention.

FIG. 6 shows a hull 111 modified by the addition of a front wheel 91 and a rear rudder wheel or steering wheel 92, such wheels adapting the craft to amphibious or land use. The front wheel 91 is removably mounted on an axle 94 through a suitable aperture 93 in the hull to suitable framing 95 within the hull (see also FIG. 3). An aperture plug fills the aperture 93 when wheel 91 is removed. The amphibious rudder wheel 92 is operatively connected to the control column and control system in the same way as the marine rudder described earlier. A working craft according to this modification will of course have a second wheeled hull 111 to match the one shown here.

Figure 7:
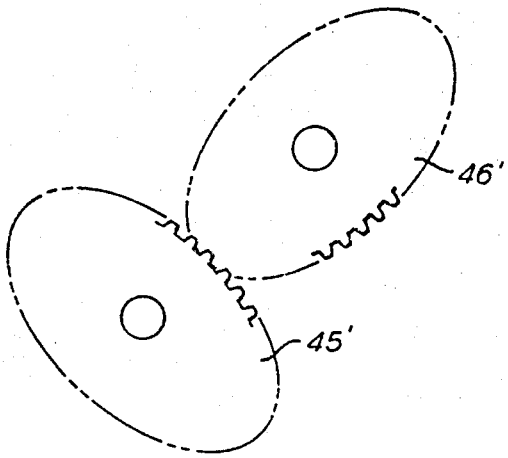
FIG. 7 is an elliptical gear configuration for use in a modified form of the invention.

A modified gear arrangement is illustrated in FIG. 7 in which control gear 45' and reaction gear 46' are elliptical gears. They may also be belt connected or cable connected elliptical pulleys. These elliptical gear or pulley arrangements, as alternatives to circular gears, may provide benefits such as leverage for holding the sail-wing in a close hauled position, or rotational speed for changing the sail-wing position when coming about.

The foregoing description of certain details and embodiments of this invention is given by way of illustration. The concept and scope of the invention are not limited by the details of their description, however, but by the purview of the following claims.

What is claimed is:

1. A sail-wing system for a sail craft, including:

a mast rotatable on its own axis and mounted on said sail craft;

a boom rotatable on its own axis and mounted on said mast, said boom adapted for mounting a sail-wing thereto; and mechanism to rotate said boom to thereby control the attitude of a sail-wing mounted thereto, said mechanism including left and right sheets operatively connected to said mast and to said boom to selectively rotate said boom on its axis, and means to selectively pull one or the other of said sheets;

said mechanism further including a control column pivotally movable on vertical and horizontal pivot axes and operatively connected to said mast to rotate said mast on the axis thereof in a direction opposite the direction of pivot of said control column on the vertical pivot axis thereof.

2. A sail-wing system as defined in claim 1, further including an elliptical gear fixed to said control column and mating with an elliptical gear fixed to said mast.

3. A sail-wing system as defined in claim 1, said mechanism further including:

a control wheel rotatably mounted on said control column and operatively connected to said sheets to pull one or the other of said sheets as said wheel is turned respectively one way or the other.

4. A sail-wing system as defined in claim 3, said control wheel further being operative to pull both of said sheets as said control column is pivoted downward on the horizontal pivot axis thereof.

5. A sail-wing system as defined in claim 3, said control column further being operatively connected to a rudder, and including a steering wheel fixed to said control column.

6. A sail-wing system for a sail craft, including:

a mast rotatable on is own axis and mounted on said sail craft;

a boom rotatable on its own axis and mounted on said mast;

a sail-wing mounted to said boom and rotatable therewith about horizontal and vertical axes for varying the attitude of said sail-wing; and mechanism to control the attitude of said sail-wing, said mechanism including left and right sheets operatively connected to said mast and to said boom to rotate said boom, and means to selectively pull one or the other or both of said sheets;

said mechanism further including a control column pivotally movable on vertical and horizontal pivot axes and operatively connected to said mast to rotate said mast on the axis thereof in a direction opposite the direction of pivot of said control column on the vertical pivot axis thereof; and a control wheel rotatably mounted on said control column and operatively connected to said sheets to pull or the other of said sheets as said wheel is turned respectively one way or the other.

7. A sail-wing system as defined in claim 6, said control wheel further being operative to pull both of said sheets as said control column is pivoted downward on the horizontal pivot axis thereof.

8. A sail craft, including:

a mast rotatable on its own axis and mounted on said sail craft;

a boom rotatable on its own axis and mounted on said mast, said boom adapted for mounting a sail-wing thereto; and mechanism to rotate said boom to thereby control the attitude of a sail-wing mounted thereto, said mechanism including left and right sheets operatively connected to said mast and to said boom to selectively rotate said boom on its axis, and means to selectively pull one or the other of said sheets;

said mechanism further including a control column pivotally movable on vertical and horizontal pivot axes and operatively connected to said mast to rotate said mast on the axis thereof in a direction opposite the direction of pivot of said control column on the vertical pivot axis thereof.

9. A sail craft as defined in claim 8, said mechanism further including:

a control wheel rotatably mounted on said control column and operatively connected to said sheets to pull one or the other of said sheets as said wheel is turned respectively one way or the other.

10. A sail craft as defined in claim 9, said control wheel further being operative to pull both of said sheets as said control column is pivoted downward on the horizontal pivot axis thereof.

11. A sail craft as defined in claim 9, said control column further being operatively connected to an amphibious rudder, and including a steering wheel fixed to said control column.

12. A sail craft including:

a bridging platform mounted on twin hulls, said platform including a seat having a back stop curved in the plane of said platform, and a diametrically opposed curved foot rail, said back stop and said foot rail providing pilot support and leverage for lateral movement on said platform:

a mast rotatable on its own axis and mounted on said bridging platform:

a boom rotatable on its own axis and mounted on said mast, said boom adapted for mounting a sail-wing thereto; and mechanism to rotate said boom to thereby control the attitude of a sail-wing mounted thereto, said mechanism including left and right sheets operatively connected to said mast and to said boom to selectively rotate said boom on its axis, and means to selectively pull one or the other of said sheets.

13. A sail craft as defined in claim 12, further including hydrofoil planing means on said hulls.

14. A sail craft as defined in claim 12, further including means to mount removable wheels to render said craft amphibious.

15. A sail craft including a platform on the hull of said craft, said platform including a seat having a back stop curved in the plane of sail platform, and a diametrically opposed curved foot rail, said back stop and said foot rail providing pilot support and leverage for lateral movement on said platform: and a control column pivotally movable relative to said hull on vertical and horizontal pivot axes; and a rotatable steering wheel fixed to said control column and operatively connected to a rudder.

16. A sail craft as defined in claim 15 in which said platform is a bridging platform extending between twin hulls.

17. A sail craft, including:

a platform on the hull of said craft including a seat having a back stop curved in the plane of said platform, and a diametrically opposed curved foot rail, said back stop and said foot rail providing pilot support and leverage for lateral movement on said platform:

a mast rotatable on its own axis and mounted on said platform:

a control column pivotally movable on vertical and horizontal pivot axes and operatively connected to said mast to rotate said mast on the axis thereof in a direction opposite the direction of pivot and said control column on the vertical pivot axis thereof: and a rotatable steering wheel to said control column and operatively connected to a rudder.

18. A sail craft as defined in claim 17 in which said platform is a bridging platform extending between twin hulls.

* * * * *